US005765312A

United States Patent [19]

Szyjkowski

[11] Patent Number: 5,765,312

[45] Date of Patent: Jun. 16, 1998

[54] ACCESS PANEL INCORPORATING A SPRING CLAMPING DEVICE

[76] Inventor: Jerzy Szyjkowski, 6 Livingston Drive, Caledon, Ontario, L7C 1A7, Canada

[21] Appl. No.: 680,230

[22] Filed: Jul. 11, 1996

[51] Int. Cl.[6] ..... E06B 3/32

[52] U.S. Cl. ..... 49/465; 49/463

[58] Field of Search ..... 49/463, 465, 57; 52/514.5, 220.8, 208, 202

[56] References Cited

U.S. PATENT DOCUMENTS

| | | | |
|---|---|---|---|
| 14,680 | 4/1856 | Titus | 49/463 |
| 2,156,110 | 4/1939 | Brukner | 49/465 |
| 2,486,670 | 11/1949 | Nigg et al. | 24/221 |
| 2,662,260 | 12/1953 | Marschner | 24/221 |
| 2,882,580 | 4/1959 | Barsalou | 24/221 |
| 3,340,661 | 9/1967 | Krieger | 52/456 |
| 3,383,811 | 5/1968 | Ades | 52/28 |
| 3,704,563 | 12/1972 | Waller | 52/455 |
| 4,113,303 | 9/1978 | Yench | 296/137 |
| 4,890,418 | 1/1990 | Sachs | 49/463 |
| 4,970,836 | 11/1990 | Brown | 52/221 |
| 5,073,075 | 12/1991 | Duran | 411/552 |
| 5,201,157 | 4/1993 | Thornton et al. | 49/465 X |
| 5,267,820 | 12/1993 | Sturtevant | 411/551 |
| 5,361,541 | 11/1994 | Szyjkowski | 49/465 |
| 5,551,191 | 9/1996 | Maiwandi | 49/465 |

FOREIGN PATENT DOCUMENTS

| | | |
|---|---|---|
| 2424372 | 11/1979 | France . |
| 1134151 | 3/1996 | United Kingdom . |

*Primary Examiner*—Jerry Redman
*Attorney, Agent, or Firm*—Peter R. Hammond

[57] ABSTRACT

An access panel for installation over an opening in panelling of a wall or ceiling of a structure includes a plate having two opposite side edges and a positioning flange extending rearwardly from a rear surface of the plate, this flange being located inwardly from adjacent edges. The panel includes two elongate clamping elements, each extending towards a respective one of the side edges from a central region of the plate attached to a rear side of the plate. Each clamping element is made of a resilient springy material so that an outer end portion can be pulled away from the plate during installation. These elements are used to secure the panel to opposite sides of the opening. Preferably each clamping element has a special profile to enable fast and easy installation over the opening.

14 Claims, 1 Drawing Sheet

FIG. 1

ACCESS PANEL INCORPORATING A SPRING CLAMPING DEVICE

BACKGROUND OF THE INVENTION

This invention relates to access panels which can be used to cover an opening in a wall or ceiling and to provide ready access to an installation accessible through the opening.

Removable access doors or covers for covering small openings in a wall or ceiling are known, including an access door or cover that includes a panel member and devices for attaching the panel member to the wall or ceiling. Many of the known access doors and panels require some kind of framing in order that they can be used and secured. In many cases, the framing is attached to the studs of the wall. However, access panels which do not require framing are also known and such panels may be installed at any desired location where an opening is formed in the surface of the wall or ceiling. The provision of these access panels is especially useful to enable repair work to be carried out on installations located behind wall or ceiling panelling. They can also be useful in new structures or buildings.

Some known removable access panels that are available on today's market are somewhat complicated and expensive to manufacture.

It is an object of the present invention to provide a removable cover or access panel which is simple in its construction and comparatively easy to use.

It is a further object of the invention to provide a removable cover for covering an access opening in a structure which can be manufactured at low cost and which is also reliable.

SUMMARY OF THE INVENTION

According to one aspect of the invention, a removable cover for covering an access opening in a structure comprises a plate member having two opposite side edges and a positioning flange extending rearwardly from a rear surface of the plate member. The flange is located inwardly from an adjacent edge of the plate member. At least two elongate clamping elements are provided and each extends generally towards a respective one of the side edges from a central region of the plate member. Each clamping element is located on and attached to a rear side of the plate member. The clamping elements are made of a resilient, springy material so that an outer end portion of each can be pulled away from the plate member during installation of the cover over an access opening. This outer end portion is biased to move back towards the plate member when the cover has been installed over the access opening.

In a preferred embodiment, the plate member has four edges and the positioning flange is four sided with each side of the flange being located inwardly from a respective adjacent edge of the plate member.

According to a further aspect of the invention, a removable cover for covering an opening in a structure comprises a rectangular plate member having four side edges and a positioning flange extending rearwardly from a rear surface thereof. The flange is located inwardly from the side edges of the plate member. There is also at least one elongate clamping member made of resilient, springy material and extending from one of the side edges to an opposite side edge of the plate member on a rear side thereof. The clamping member is attached to the plate member midway between the one side edge and the opposite side edge at a central connecting point. The clamping member forms two spring-like sections located on opposite sides of the central connecting point. Each of these spring-like sections can be pulled away from the plate member during installation of the cover over an access opening and is biased to move toward the plate member when the cover has been installed over the access opening.

According to a further aspect of the invention, a removable cover for covering an access opening in a structure includes a plate member having two opposite side edges and a positioning flange extending rearwardly from a rear surface of the plate member. This flange is located inwardly from the side edges of the plate member. There are two separate elongate clamping members each extending generally towards a respective one of the side edges from a central region of the plate member and located on a rear side of the plate member. A pivot device including a single pivot pin is provided for pivotally connecting the two clamping members at their inner ends to the plate member midway between the opposite side edges. A common spring biases both of the clamping members to pivot them toward the plate member. An outer end of each clamping member can be pulled away from the plate member during installation of the cover over an access opening and moves back toward the plate member when the cover has been installed over the access opening.

Further features and advantages will become apparent from the following detailed description taken in conjunction with the accompanying drawings.

DETAILED DESCRIPTION OF PREFERRED EMBODIMENTS

Figure 1:
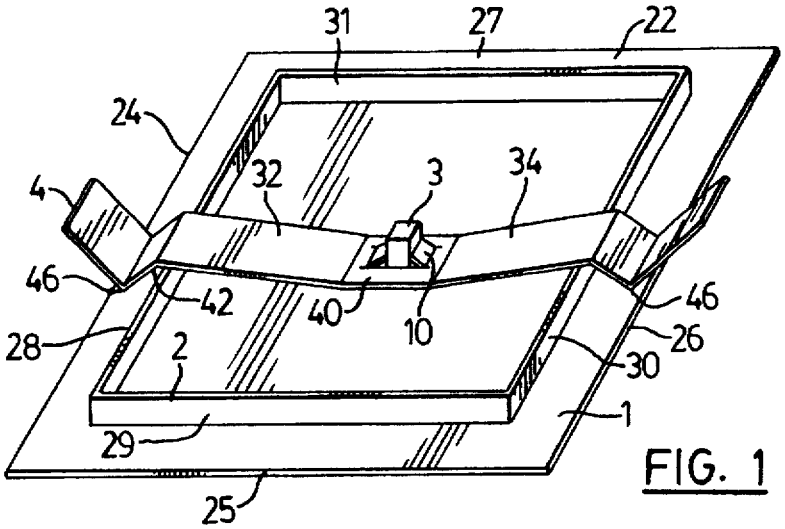
FIG. 1 is a perspective view of a first embodiment constructed in accordance with the invention, this view showing the rear side of the removable cover.

A removable cover or access panel for covering an access opening 20 comprises a panel or plate member 1 with an attached or integral positioning flange 2 extending rearwardly from a rear surface 22 of the panel. As shown, the flange 2 is located inwardly from adjacent edges of the panel. The illustrated rectangular panel has four side edges 24 to 27. The illustrated preferred flange 2 is four sided and each of the sides 28 to 31 is located inwardly from a respective adjacent edge of the plate member 1.

Figure 6:
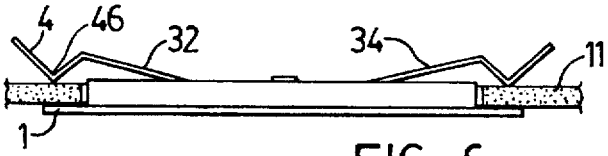
FIG. 6 is an edge view of the first embodiment showing this embodiment fully installed in the opening.

The preferred removable cover has a spring member 4 located on and attached to the rear side of the plate member 1. This spring member forms an elongate clamping member made of resilient, springy material and extending from one side edge 24 to an opposite side edge 26 of the plate member. The illustrated preferred clamping member forms two elongate clamping elements 32 and 34, each of which extends generally towards a respective one of two opposite side edges 24, 26 from a central region of the plate member. Because of the resilient, springy nature of the clamping element, an outer end portion 36 of each clamping element can be pulled away from the plate member 1 during installation of the cover over an access opening 20. Furthermore, this outer end portion 36 is biased to move back toward the plate member when the cover member has been installed over the access opening as shown in FIG. 6.

In the preferred embodiment shown, the plate member 1 is formed in its centre with a spring holder or connecting member 3. Preferably this connecting member 3 is integrally formed on the rear side of the plate member as indicated in FIG. 2 and is centrally located, both widthwise and lengthwise, on the rear of the plate member. The preferred connecting member 3 has a rectangular or square cross-section in a plane parallel to the rear side 22 of the plate member. Also, the clamping member or spring 4 has a substantially rectangular hole 40 formed at the centre thereof and the connecting member 3 extends through this hole and is held therein. The preferred clamping member is formed with two self-locking tabs 10 located on opposite sides of the hole 40 and these tabs seize the connecting member 3 in order to attach the clamping member 4 to the plate member 1. Due to the square cross-section of the connecting member 3, the clamping member 4 is prevented from swinging out of its proper position (illustrated in FIG. 1). The connecting member 3 provides an easy, economical way of attaching the clamping member 4 to the panel member. The tabs 10 which seize the connecting member 3 help provide proper and permanent assembly of the cover.

It will be appreciated that the profile of the spring or clamping member 4 is key to proper operation of the clamping member. The clamping member has the aforementioned two outer end portions or opposite end sections 36, each of which is sharply bent twice. The first bend 42 causes the end section to extend both outwardly away from the center region of the plate indicated at 43 and towards the rear side 22 of the plate member. The second sharp bend 46 causes the end section to extend both outwardly away from the center region 43 and away from the rear side 22 of the plate member. Also, preferably each clamping element 32, 34 extends outwardly beyond its respective side edge 24, 26 as shown clearly in FIG. 2. The final outer end section 50 of the clamping element extends at an acute angle to the rear side 22 of the plate member. As shown in FIG. 6, it is the second sharp bend 46 of each clamping element 32, 34 which engages the internal surface of the panelling 11 after installation of the cover.

The installation of the access panel or cover will now be explained with reference to FIG. 3 to 6 of the drawings.

Figure 3:
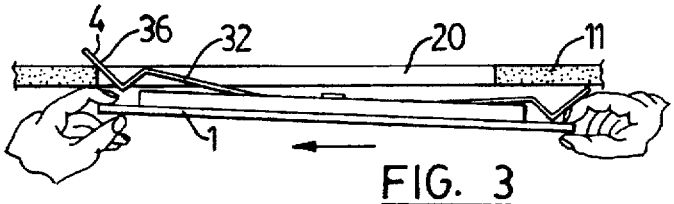
FIG. 3 is an edge view of the first embodiment shown being inserted into an opening in panelling.
Figure 4:
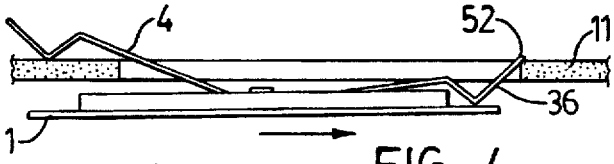
FIG. 4 is an edge view of the first embodiment showing the next step in the installation procedure where one of the clamping elements has been pushed behind the panelling.
Figure 5:
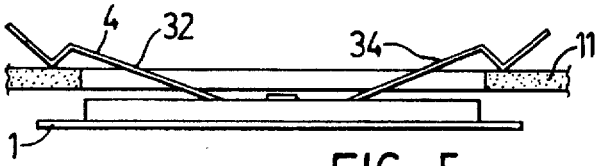
FIG. 5 is an edge view of the first embodiment showing the next step in the installation procedure where both of the clamping elements have been inserted behind the panelling.

The first step in the installation procedure for the access panel 1, after an adequate opening 20 in the panel has been made, is to bring the panel level with the opening 20 and to arrange it at a small angle in relation to the outer surface of the panel as shown in FIG. 3. The outer end portion 36 of one of the clamping elements is brought into position so that it projects to the rear of the panel. Then, the installer slides the panel 1 in the direction indicated by the arrow in FIG. 3, resulting in the clamping element being engaged with the rear side of the panelling as shown in FIG. 4. The panel 1 is moved to the left (as seen in FIGS. 3 and 4) a sufficient distance that the opposite end 52 of clamping member 4 is moved into the area directly in front of the opening 20, at which point the end 52 and its respective outer end portion 36 can be moved rearwardly into the opening 20. Once the end 52 has passed through the opening 20, the panel 1 can be forced or moved to the right as indicated by the arrow in FIG. 4. Due to the slope of the end portion 36, this movement will result in the outer end portion of clamping element 34 being engaged with the rear surface of the panelling 11 as shown in FIG. 5. Then, to complete the installation procedure, the panel 1 is properly aligned both vertically and horizontally with the opening 20 so that the sides of the flange can pass into the opening 20 upon release of the panel 1 into the opening. It will be appreciated that the panel 1 is biased to move into the opening 20 by the spring clamping elements 32, 34.

In order to remove the access panel 1, the above described installation steps are followed in reverse. If the clamping elements 32, 34 are sufficiently flexible, the panel 1 can simply be pulled away from the opening 20 in order to remove the panel.

Figure 8:
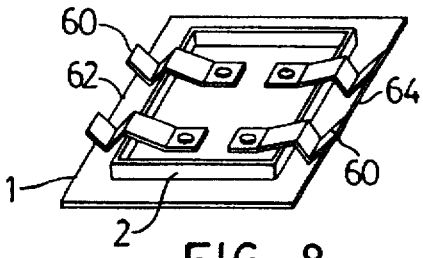
FIG. 8 is a perspective view similar to FIG. 7 but showing a third embodiment constructed in accordance with the invention.

In the alternate embodiment shown in FIG. 8, there are four separate elongate clamping elements 60 attached to the rear side of the panel or plate member 1. In the illustrated embodiment two of the clamping elements 60 extend generally towards a respective one of the side edges 62, 64 of the plate member. In this embodiment, there are shown two pairs of clamping elements with the elements of each pair aligned in the widthwise direction, that is the direction perpendicular to the edges 62, 64.

Figure 7:
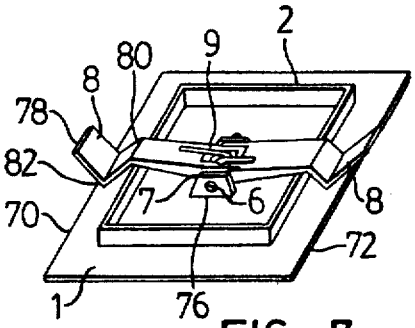
FIG. 7 is a perspective view of a second embodiment of the invention, this view showing the rear side of the cover.

Turning now to the third embodiment shown in FIG. 7 of the drawings, this embodiment also has a plate member 1 with two opposite side edges 70, 72 and a positioning flange 2 extending rearwardly from the rear surface of the plate member. Again, the flange is located inwardly from the side edges of the plate member. There are two separate but similar elongate clamping members or clamping arms 8 each extending generally towards a respective one of the side edges 70, 72 from a central region of the plate member. These clamping members are located on the rear side of the plate member and are pivotably connected at their inner ends to the plate member by means of pivot means 6. The pivot means includes two rearwardly extending lugs 76 and a pivot pin extending through these lugs and through the inner ends of the clamping members. The lugs are located midway between the opposite side edges 70, 72. Spring means which can be in the form of common spring 9 bias both of the clamping members 8 to pivot toward the plate member 1. The lugs can be integrally formed on the plate or can be attached to the rear surface. The embodiment of FIG. 7 is similar in its use and operation to the embodiment of FIGS. 1 and 2 and it can be installed or removed in substantially the same manner as that embodiment. Thus, an outer end 78 of each clamping member 8 can be pulled away from the plate member 1 during installation of this cover over an access opening and this outer end moves back towards the plate member when the cover has been installed over the access opening.

In the embodiment of FIG. 7, each clamping member 8 has an outer end section which is sharply bent twice. The first bend at 80 causes the end section to extend both outwardly away from the center region of the plate and towards the rear side of the plate while the second bend 82 causes the end section to extend both outwardly away from the center region of the plate and away from the rear surface of the plate member.

Figure 2:
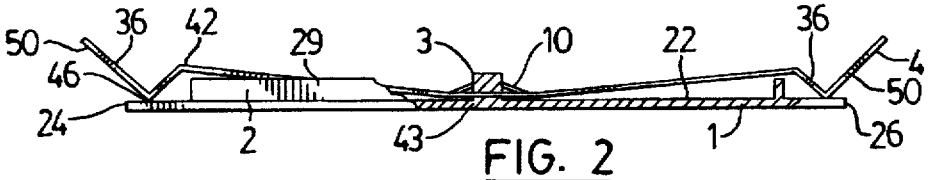
FIG. 2 is an edge view of the first embodiment with a portion of the cover being shown in cross-section.

The removable cover of FIGS. 1 and 2 and that of FIG. 8 can have their plate members and the clamping elements entirely molded out of plastic. In the alternative, the clamping member or the clamping elements can be made of a suitable sheet metal or out of wire. Also, if desired, in the versions of FIGS. 1, 2 and 8, the plate member 1 and the clamping elements can be integrally molded as a single piece of plastic, thus avoiding the need for any assembly.

It will be appreciated that larger sizes of the present removable cover or access panel can incorporate a series of either the spring members of FIGS. 1 and 2 or the spring elements of FIG. 8.

Although a complete four sided flange 2 is shown in the drawings, it will be understood by those skilled in the art that the flange can be a partial flange which will still help ensure proper installation of the removable cover and prevent it from sliding away from the opening 20.

It will be appreciated that once the removable cover of the invention has been installed over an opening, it presents a very aesthetic appearance as the external surface thereof is not interrupted by any screws or latching mechanisms. Furthermore, the removable cover described herein is inexpensive and can provide a very reliable cover for an opening. Furthermore, covers constructed in accordance with the invention can be used with different kinds of panelling having different thicknesses. The cover can be installed or removed very quickly when required for repairs or servicing of an installation located behind the cover.

The preferred flange 2 leaves a sufficient margin between itself and the adjacent edge of the plate to allow for any imperfections in the edges of the opening while still permitting the opening to be properly covered. Furthermore, the provision of the flange 2 serves as a stiffener of the plate 1.

It will be understood that the clamping member or clamping spring can be attached in various ways to the rear side of the panel. Depending on the materials used for the panel and the clamping member, a clamping member can be attached by welding, by bonding or by means of a standard fastener.

The embodiments of the invention, in which an exclusive property or privilege is claimed are as follows:

1. A removable cover suitable for covering an access opening in a structure, said removable cover comprising a plate member having two opposite side edges, a centrally located connecting member integrally formed on a rear side of the plate member, and a positioning flange extending rearwardly from said rear side of said plate member, said positioning flange being located inwardly from an adjacent edge of the plate member, said connecting member having a rectangular cross-section in a plane parallel to said rear side of the plate member, at least two elongate clamping elements formed from a single, elongate clamping member, each of the clamping elements extending generally towards a respective one of said side edges from a central region of the plate member and and attached to said connecting member on said rear side of said plate member, each clamping element being made of a resilient, springy material so that an outer end portion can be pulled away from said plate member during installation of said cover and is biased to move back toward said plate member when said cover has been installed, wherein said clamping member has a substantially rectangular hole formed at a center of said clamping member and said connecting member extends through said hole and is held therein.

2. A removable cover according to claim 1 wherein said plate member has four edges, said positioning flange is four sided, and each side of said positioning flange is located inwardly from a respective adjacent edge of the plate member.

3. A removable cover according to claim 1 wherein said clamping member is formed with two self-locking tabs located on opposite sides of said hole and said tabs seize said connecting member in order to attach the clamping member to said plate member.

4. A removable cover according to claim 1 wherein said clamping member has two opposite end sections each of which is bent twice to form a first bend and a second bend, the first bend causing each of the end sections to extend both outwardly away from said center region and towards said rear side of the plate member and the second bend causing each of the end sections to extend both outwardly away from said center region and away from said rear side of the plate member.

5. A removable cover according to claim 1 wherein each clamping element extends outwardly beyond its respective side edge of the plate member and has an outer end section extending at an acute angle to said rear side of the plate member.

6. A removable cover according to claim 1 wherein each clamping element extends outwardly beyond its respective side edge of the plate member and has an outer end section extending at an acute angle to said rear side of the plate member.

7. A removable cover according to claim 1 wherein said plate member and said clamping elements are entirely molded out of plastic.

8. A removable cover according to claim 7 wherein said plate member and said clamping elements are integrally molded as a single piece.

9. A removable cover according to claim 1 wherein there are four of said elongate clamping elements attached to said rear side of the plate member and two of these clamping elements extend generally towards a respective one of said side edges of the plate member.

10. A removable cover suitable for covering an opening in a structure, said removable cover comprising a rectangular plate member having four side edges, a central connecting member integrally formed on a rear side of the plate member, and a positioning flange extending rearwardly from said rear side of said plate member, said positioning flange being located inwardly from the side edges of the plate member, said connecting member having a rectangular cross-section in a plane parallel to said rear side of the plate member, at least one elongate clamping member made of resilient, springy material and extending from one of said side edges to an opposite side edge of the plate member on a rear side thereof, said clamping member being attached to said connecting member midway between said one side edge and said opposite side edge, wherein said clamping member forms two spring-like sections located on opposite sides of said central connecting point and each of said spring-like sections can be pulled away from said plate member during installation of said cover and is biased to move back toward said plate member when said cover has been installed, wherein said clamping member has a substantially rectangular hole formed at a center of said clamping member and said connecting member extends through said hole and is held therein.

11. A removable cover according to claim 10 wherein said positioning flange is four sided and each side of said positioning flange is located inwardly from a respective adjacent side edge of the plate member.

12. A removable cover according to claim 11 wherein each spring-like section has an outer end section which is sharply bent twice to form a first bend and a second bend, the first bend causing the end section to extend both outwardly away from said central connecting point and towards said rear side of the plate member and the second bend causing the end section to extend both outwardly away from said central connecting point and away from said rear side of the plate member.

13. A removable cover according to claim 10 wherein each spring-like section extends outwardly beyond its respective side edge of the plate member and has an outer end section extending at an acute angle to said rear side of the plate member.

14. A removable cover according to claim 10 wherein said plate member and said clamping member are entirely molded out of plastic.

* * * * *